US005114371A

United States Patent [19]

Alonzo

[11] Patent Number: 5,114,371

[45] Date of Patent: May 19, 1992

[54] WATER PADDLE AND FLOTATION DEVICE FOR USE BY SWIMMERS

[75] Inventor: Rudy Alonzo, Pico Rivera, Calif.

[73] Assignee: California Aqua Paddle, Inc., Anaheim, Calif.

[21] Appl. No.: 614,096

[22] Filed: Nov. 15, 1990

[51] Int. Cl.[5] ..... B63C 9/08

[52] U.S. Cl. ..... 441/129; 440/56; 440/101

[58] Field of Search ..... 441/55, 56, 129; 440/101, 102; 416/69-74

[56] References Cited

U.S. PATENT DOCUMENTS

| | | | |
|---|---|---|---|
| 1,478,525 | 12/1923 | MacKenzie | 441/56 |
| 1,509,551 | 9/1924 | Gibson | 441/56 |
| 2,941,219 | 6/1960 | Irving | 441/56 |
| 3,407,417 | 10/1968 | Garland | 441/1 |
| 3,595,537 | 7/1971 | Kaelin | 441/133 |
| 3,889,308 | 6/1975 | Persson | 441/56 |
| 4,302,194 | 11/1981 | Perales | 440/101 |

FOREIGN PATENT DOCUMENTS

| | | | |
|---|---|---|---|
| 3628637 | 3/1988 | Fed. Rep. of Germany | 440/101 |
| 640420 | 1/1984 | Sweden | 441/56 |

*Primary Examiner*—Ed Swinehart

*Attorney, Agent, or Firm*—Edgar W. Averil, Jr.

[57] ABSTRACT

An improved paddle assembly and flotation device for use by a swimmer to assist in propelling the swimmer through the water. The paddle assembly is of the type which has a central float and a pair of paddles supported by a rod extending outwardly from the float. The improvement of the present invention comprises a hollow, rigid thermoplastic ball having two openings and a hollow tube passed through the two openings and affixed to the openings in a watertight manner. Then, a rigid tube extends through the hollow tube, and the rigid tube extends outwardly and is affixed to a pair of paddles at each end of the rigid tube. Preferably, there are two or more handles affixed between the thermoplastic ball and the paddles.

10 Claims, 2 Drawing Sheets

WATER PADDLE AND FLOTATION DEVICE FOR USE BY SWIMMERS

BACKGROUND OF THE INVENTION

The field of the invention is sporting goods, and the invention relates more particularly to sporting goods of the type which are used in swimming pools, in conjunction with lakes or oceans.

Applicant's invention is an improvement of the device shown in U.S. Pat. No. 4,302,194. This device, although excellent in concept, was deficient in several respects. First, the construction shown in FIGS. 1, 5 and 7 utilized an inflatable float "B" which could easily become punctured in storage and, of course, had to be inflated for use. The alternate embodiment shown in FIG. 6 utilized a styrofoam ball but because of the torque which can occur with the use of the device, it easily became unscrewed from the tapped recess 28 and the connectors 26.

SUMMARY OF THE INVENTION

It is an object of the present invention to provide an improved paddle assembly wherein the float is a rigid ball, and the paddles are rigidly affixed to one another through a hollow opening in the ball.

The present invention is for an improved paddle assembly for use by a swimmer to assist in propelling the swimmer through the water. The paddle assembly is of the type having a central float and a pair of paddles supported at the end of a pair of rods extending outwardly from the central float. The improvement of the present invention comprises a hollow, rigid, thermoplastic ball having two diametrically opposed openings therein. A hollow tube extends through both of the diametrically opposed openings, and the hollow tube is sealed in an airtight manner at its outer surface to the two diametrically opposed openings. A rigid tube extends through the hollow tube and extends past the hollow tube at each end thereof to form first and second tube ends. First and second paddles are affixed to the first and second tube ends whereby the user may grasp the hollow tube and manipulate the paddles to propel the user rapidly through the water.

DESCRIPTION OF THE PREFERRED EMBODIMENTS

Figures 1, 2, 3, 4:
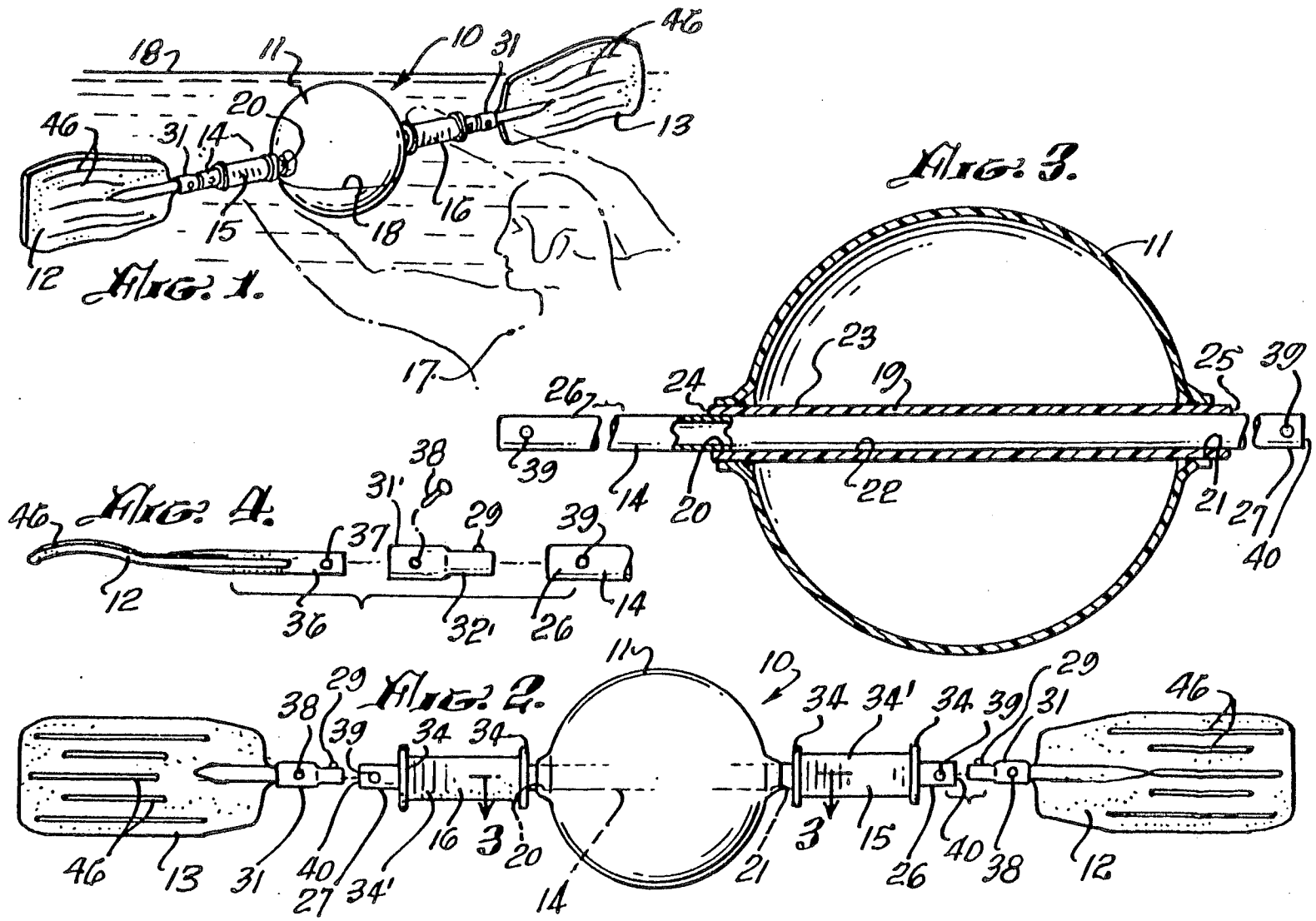
FIG. 1 is a perspective view of the improved paddle assembly of the present invention.
FIG. 2 is a rear view thereof.
FIG. 3 is an enlarged cross-sectional view taken along line 3—3 of FIG. 2.
FIG. 4 is an exploded top view of one of the paddles of the improved paddle assembly of FIG. 1 together with an aluminum tube.

The improved paddle assembly of the present invention is shown in FIG. 1 in perspective view and indicated by reference character 10. Paddle assembly 10 has a central float which comprises a hollow, rigid thermoplastic ball 11, and a pair of paddles 12 and 13 are affixed to a rigid tube 14 which extends through a central tube as shown best in FIG. 3 of the drawings. A pair of handles 15 and 16 permit the hands of swimmer 17 to be comfortably positioned on the assembly. The water level is indicated by reference character 18.

The construction of the hollow, rigid thermoplastic ball 11 is shown best in FIG. 3 where it can be seen that a hollow tube 19 is sealed to a pair of diametrically opposed openings 20 and 21 by ultrasonic welding or other suitable means. Preferably, hollow tube 19 is a plastic tube formed of the same material as thermoplastic ball 11. A rigid aluminum tube 14 has an outside diameter which is about the same as the inside diameter of hollow tube 19. It therefore tightly contacts the inner surface 22 of hollow tube 19. The outer surface 23 of hollow tube 19 contacts only the air within the hollow, rigid thermoplastic ball 11. As also shown in FIG. 3, the hollow tube 19 extends sufficiently past the ends 24 and 25 of hollow tube 19 so that handles 15 and 16 may be affixed to the ends 26 and 27.

Turning now to FIG. 2, it can be seen that the paddles 12 and 13 are removably affixed to ends 26 and 27 of rigid tube 14. This is by way of a connection lock shown best in perspective view in FIG. 6 of the drawings wherein a spring 28 has a button 29 extending therefrom which passes through a hole 30 in aluminum tube 41. Aluminum tube 41 has a swaged portion 32. This connection has the advantage of not only being easy to connect and disconnect, but also prevents providing a rotation-free connection in that button 29 locks aluminum tube 31 to rigid tube 14 because it also extend through opening 33 in tube end 26. As shown in FIG. 4, aluminum tube 31 is riveted to rod 36 which is integral with paddle 12 and includes a rivet hole 37. A rivet 38 secures tube 31' to rod 36. Swaged portion 32' fits into end 26 of tube 14. A button 29 is identical to button 29 in FIG. 6 and cooperates with hole 39 in tube 14.

The handles 15 and 16 are preferably elastomeric handles, each having a pair of end rings 34 and a ribbed center section 34'. Since the device is used in the water, the swimmer's hands are, of course, wet and the end rings 34 keep the swimmer's hands easily on the handles.

Figures 5, 6, 7:
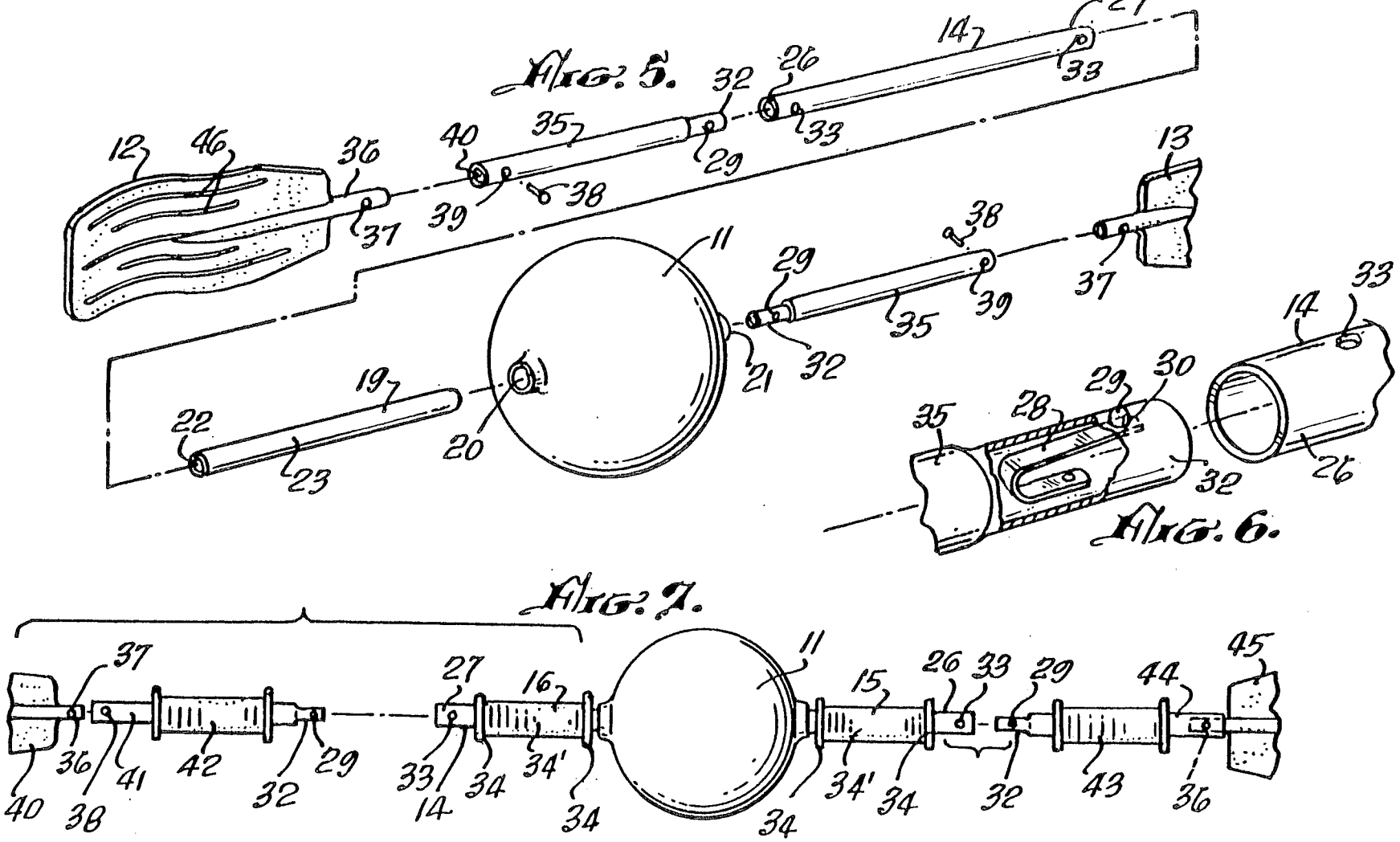
FIG. 5 is an exploded perspective view of an alternate embodiment of the paddle assembly of FIG. 1.
FIG. 6 is an enlarged perspective view of the connection lock of the improved paddle assembly of FIG. 1.
FIG. 7 is an exploded rear view of the alternate embodiment of the paddle assembly of FIG. 5.

The construction of the device is shown in exploded perspective view in FIG. 5 where it can be seen that aluminum tube 35 is held to paddle 12 by an extension rod 36 which is integral with paddle 12 and which has a hole 37 passing therethrough. Rod 36 is placed into the open end 40 of aluminum tube 35, and pin 38 passes through hole 39 in aluminum tube 35 and through hole 37 securely riveting the paddle 12 to the aluminum tube 35.

Thus, it can be seen, by consideration of FIG. 5, that paddle 12 and paddle 13 are all securely affixed to one another in a non-turning relationship. A larger configuration of the device of the present invention is shown in FIG. 7 of the drawings where paddle 40 has a hollow, aluminum tube affixed thereto, and a handle 42 is held on aluminum tube 41. Aluminum tube 41 is affixed to end 26 of rigid tube 14. Thus, the combined device has four handles, namely, 42, 15, 16 and 43. Handle 43 is, of course, held on aluminum tube 44 which affixed to paddle 45. This large model is particularly appropriate for ocean use where there is no space limitation.

It has been found by use of the device of the present invention that an inexperienced swimmer can move faster through the water than a professional lifeguard.

The device is particularly useful for rescue operations since it provides speedy movement to the swimmer in trouble and also provides a float to which the swimmer in trouble can cling. It can be disassembled so that it may be stored in a relatively small space and yet quickly reassembled in either a smaller pool configuration or the larger ocean configuration. It is rugged and durable and is expected to last for many years in use. The paddles are fabricated from polypropylene copolymer and have a plurality of ribs 46 for stiffening purposes.

The present embodiments of this invention are thus to beconsidered in all respects as illustrative and not restrictive; the scope of the invention being indicated by the appended claims rather than by the foregoing description. All changes which come within the meaning and range of equivalency of the claims are intended to be embraced therein.

What is claimed :

1. An improved paddle assembly for use by a swimmer to assist in propelling the swimmer through the water, said paddle assembly comprising:

a hollow, rigid, thermoplastic ball having two diametrically opposed openings therein, said openings including an integral, hollow, cylindrical sleeve formed therein;

a hollow, thermoplastic tube having an inner surface and an outer surface, said hollow, thermoplastic tube extending through both of said hollow, cylindrical sleeves of said diametrically opposed openings, said hollow tube being sealed in an airtight manner at its outer surface to the hollow, cylindrical sleeves of said two diametrically opposed openings;

a rigid tube extending through said hollow tube and extending beyond said hollow tube at each end thereof to form first and second tube ends; and first and second paddles affixed to said first and second tube ends whereby the user may grasp the hollow tube and manipulate the paddles to propel the user rapidly through the water.

2. The improved paddle assembly of claim 1 wherein said first and second paddles are removably affixed to said first and second tube ends.

3. The improved paddle assembly of claim 1 further including a pair of handles, one affixed between the thermoplastic ball and the first paddle and the second affixed between the thermoplastic ball and the second paddle.

4. The improved paddle assembly of claim 3 wherein said pair of handles include inner and outer stop rings to assist in maintaining the user's hands on the handles.

5. The improved paddle assembly of claim 3 wherein the handles are affixed to the first and second tube ends of the rigid tube and the paddles are removably affixed to the first and second tube ends of the rigid tube.

6. The improved paddle assembly of claim 5 wherein there is a second pair of handles, one of said second pair being affixed between the first paddle and its point of attachment to the rigid tube and the second handle being affixed between the second paddle and its point of attachment to the rigid tube.

7. An improved paddle assembly for use by a swimmer to assist in propelling the swimmer through the water, said paddle assembly comprising:

a hollow rigid, thermoplastic ball having two diametrically opposed openings therein, said openings including an integral hollow, cylindrical sleeve formed therein;

a hollow, thermoplastic tube having an inner surface and an outer surface, said hollow tube extending through both of said hollow, cylindrical sleeves of said diametrically opposed openings, said hollow tube being sealed in an airtight manner at its outer surface to the hollow, cylindrical sleeves of said two diametrically opposed openings;

a rigid tube extending through said hollow tube and extending beyond said hollow tube at each end thereof to form first and second tube ends;

a first handle affixed to the first tube end;

a second handle affixed to the second tube end;

first and second paddles removably affixed to said first and second tube ends whereby the user may grasp the handles and manipulate the paddles to propel the user rapidly through the water.

8. The improved paddle assembly of claim 7 wherein a second pair of handles is affixed between the first and second paddles and the first and second tube ends.

9. The improved paddle assembly of claim 7 wherein said hollow tube is ultrasonically welded to the hollow rigid thermoplastic ball.

10. The improved paddle assembly of claim 9 wherein said rigid tube is an aluminum tube.

* * * * *